US008127848B2

(12) United States Patent
Myers, Jr. et al.

(10) Patent No.: US 8,127,848 B2
(45) Date of Patent: Mar. 6, 2012

(54) SELECTIVELY ANGLED PERFORATING

(75) Inventors: William D. Myers, Jr., Spring, TX (US); Randy L. Evans, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 300 days.

(21) Appl. No.: 12/412,101

(22) Filed: Mar. 26, 2009

(65) Prior Publication Data

US 2009/0242198 A1 Oct. 1, 2009

Related U.S. Application Data

(60) Provisional application No. 61/039,595, filed on Mar. 26, 2008.

(51) Int. Cl.
*E21B 43/119* (2006.01)

(52) U.S. Cl. ..... 166/297; 175/4.51

(58) Field of Classification Search ..... 166/297, 166/298, 66, 255.1, 255.2; 175/4.51
See application file for complete search history.

(56) References Cited

U.S. PATENT DOCUMENTS

| | | | | |
|---|---|---|---|---|
| 1,731,553 | A | 10/1929 | Van Keulen | |
| 2,974,589 | A * | 3/1961 | Bryan | 175/4.53 |
| 3,062,294 | A | 11/1962 | Huitt et al. | |
| 3,163,112 | A | 12/1964 | Rhea | |
| 4,074,756 | A | 2/1978 | Cooke, Jr. | |
| 4,105,073 | A | 8/1978 | Brieger | |
| 4,442,891 | A | 4/1984 | Wood | |
| 4,552,234 | A | 11/1985 | Revett | |
| 4,756,371 | A | 7/1988 | Brieger | |
| 4,961,365 | A | 10/1990 | Rytlewski | |
| 5,040,619 | A | 8/1991 | Jordan et al. | |
| 5,095,801 | A | 3/1992 | Lopez de Cardenas | |
| 5,318,123 | A | 6/1994 | Venditto et al. | |
| 5,765,642 | A * | 6/1998 | Surjaatmadja | 166/297 |
| 5,964,294 | A | 10/1999 | Edwards et al. | |
| 6,397,947 | B1 | 6/2002 | Behrmann et al. | |
| 6,679,327 | B2 | 1/2004 | Sloan et al. | |
| 7,159,657 | B2 | 1/2007 | Ratanasirigulchia et al. | |
| 7,172,023 | B2 | 2/2007 | Barker et al. | |
| 7,303,017 | B2 | 12/2007 | Barker et al. | |
| 2005/0194146 | A1 | 9/2005 | Barker et al. | |
| 2005/0247447 | A1 * | 11/2005 | Spring et al. | 166/55.2 |
| 2006/0118303 | A1 | 6/2006 | Schultz et al. | |

OTHER PUBLICATIONS

International Search Report and Written Opinion for PCT/US 2009/038595, dated Sep. 28, 2010, 5 pages.
Almaguer, Jim et al., Orienting Perforations in the Right Direction, Oilfield Review, Spring 2002, pp. 16-31.
Oilfield Review, Spring 2000, pp. 54-74.
Almaguer et al., "Orienting Perforations in the Right Direction" Oilfield Review, Spring 2002, pp. 16-31.
Behrmann et al., "Perforating Practices That Optimize Productivity", Oilfield Review, Spring 2000, pp. 52-74.

* cited by examiner

*Primary Examiner* — David Bagnell
*Assistant Examiner* — Richard Alker
(74) *Attorney, Agent, or Firm* — Bracewell & Giuliani LLP

(57) ABSTRACT

A method of perforating a wellbore by forming a perforation that is aligned with a reservoir characteristic, such as direction of maximum stress, lines of constant formation properties, and the formation dip. The wellbore can be perforated using a perforating system employing a shaped charge, a mechanical device, or a high pressure fluid. The perforating system can be aligned by asymmetric weights, a motor, or manipulation from the wellbore surface.

8 Claims, 3 Drawing Sheets

7
3
9
1
5
4a
16
14
10a
12a
Ax
6a
2
8

7
3
9
1
5
4
16
14
10
12
Ax
6
2
8

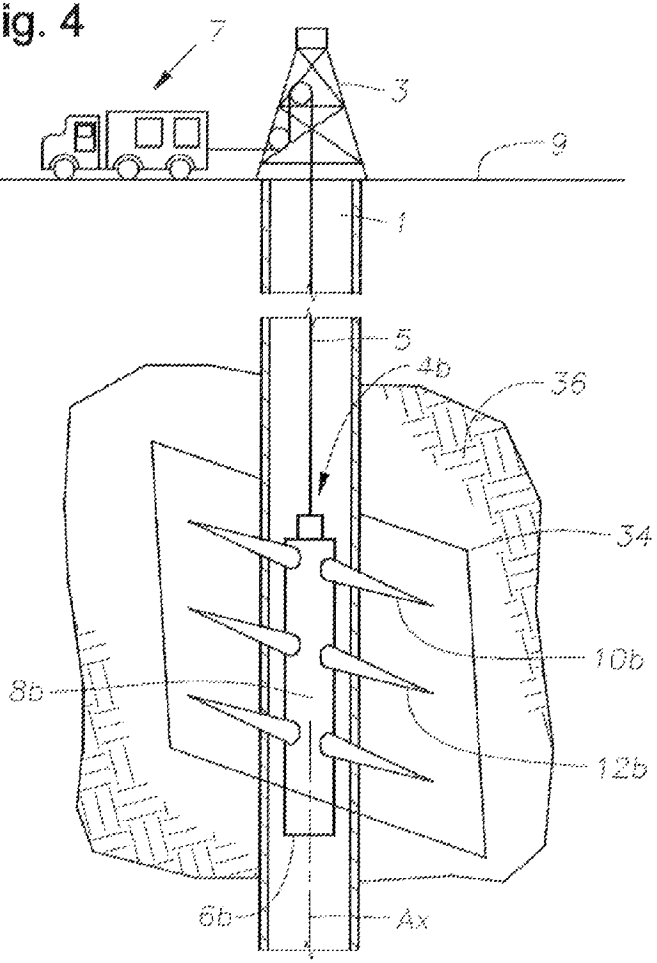
Fig. 4
Fig. 3
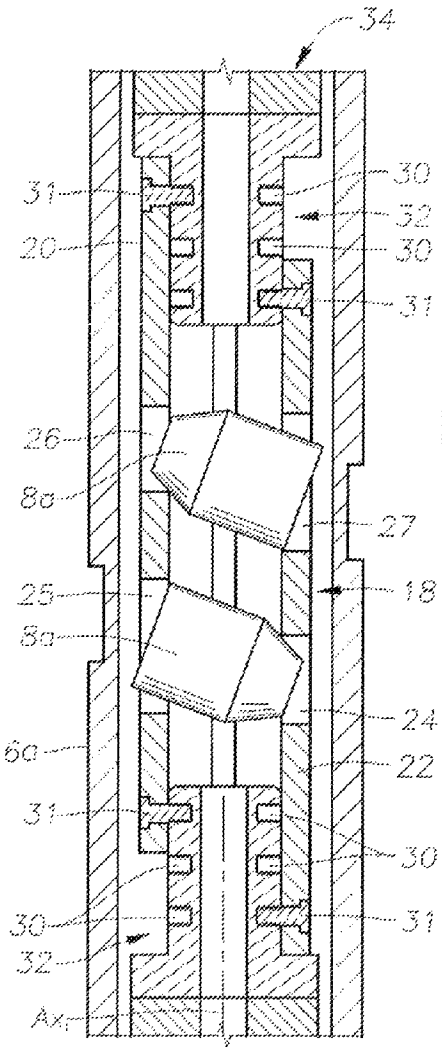

SELECTIVELY ANGLED PERFORATING

CROSS REFERENCE TO RELATED APPLICATIONS

This application claims priority to and the benefit of co-pending U.S. Provisional Application Ser. No. 61/039,595, filed Mar. 26, 2008, the full disclosure of which is hereby incorporated by reference herein.

BACKGROUND

1. Field of Invention

The invention relates generally to the field of oil and gas production. More specifically, the present invention relates to a perforating system. Yet more specifically, the invention concerns aligning perforations based on one or more reservoir characteristics.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 an example of a perforating system 4 is shown. For the sake of clarity, the system 4 depicted comprises a single perforating gun 6 instead of a multitude of guns. The gun 6 is shown disposed within a wellbore 1 on a wire line 5. The perforating system 4 as shown also includes a service truck 7 on the surface 9, where in addition to providing a raising and lowering means, the wire line 5 also provides communication and control connectivity between the truck 7 and the perforating gun 6. The wire line 5 is threaded through pulleys 3 supported above the wellbore 1. As is known, perforating systems may also be disposed into a wellbore via tubing, drill pipe, slick line, coiled tubing, to mention a few.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2. Generally the wellbore pressure is different from the pressure within the formation 2, thus upon perforation pressure equalization occurs between the formation and the wellbore which in turn produces either flow into the wellbore from the formation, or into the formation from the wellbore.

SUMMARY OF INVENTION

Disclosed herein is a method of perforating wherein the perforations are aligned with a characteristic of the reservoir. In one embodiment, the perforations are aligned with a reservoir characteristic such as the direction of maximum stress or the formation dip. Disclosed herein is also method of perforating a wellbore that intersects a formation, the method involving forming a perforation in the wellbore, where the perforation is aligned with the direction of maximum stress or the formation dip. The method may further comprise disposing a perforating system in the wellbore, the direction of maximum stress or the perforating system comprising a shaped charge, aiming the shaped charge for alignment with the direction of maximum stress or the formation dip, and detonating the shaped charge. The perforating system may further comprise a body housing the shaped charge with the method further comprising orienting the body to aim the shaped charge for alignment with the direction of maximum stress or the formation dip. The step of orienting may include asymmetrically weighting the body, rotating the body with a motor, or rotating the body from the wellbore surface. Perforating can be performed with shaped charges, mechanical drilling devices or systems, or high pressure fluid. Optionally, the charges may be rotated about a pivot point for orientation purposes.

BRIEF DESCRIPTION OF DRAWINGS

Some of the features and benefits of the present invention having been stated, others will become apparent as the description proceeds when taken in conjunction with the accompanying drawings, in which:

FIG. 3 is a partial cutaway view of a gun tube having shaped charges.

FIG. 4 is a partial cutaway view of a wellbore and a surrounding formation with a zone of maximum stress.

Figure 2:
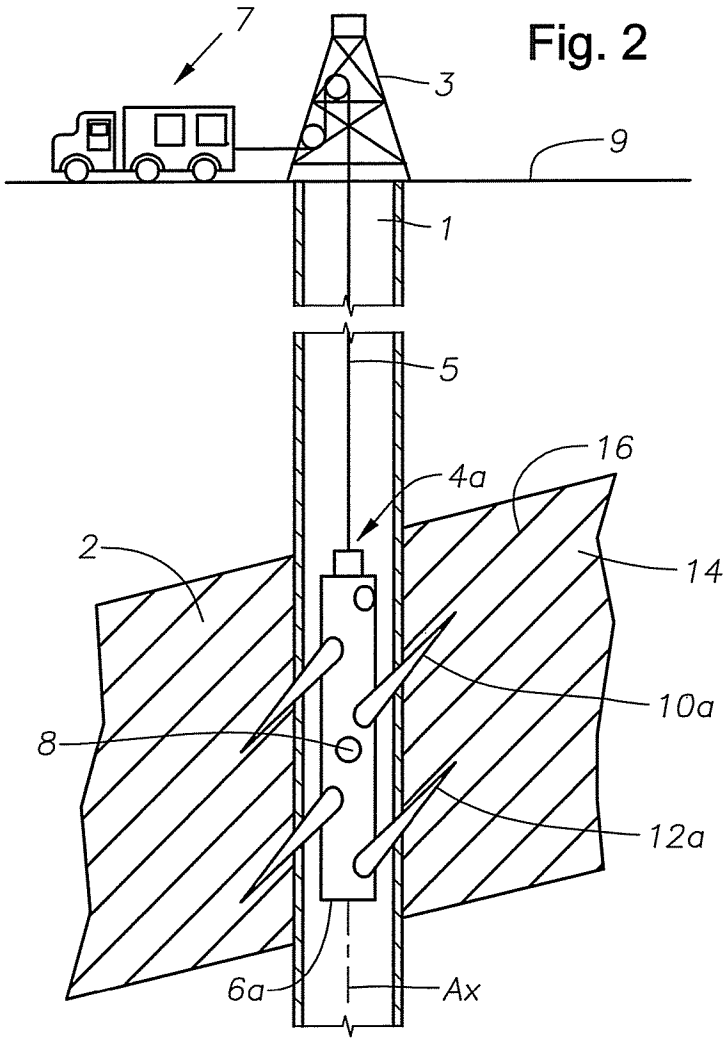
FIG. 2 is side cutaway views of a perforating system aligned with a formation dip angle.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

Figure 1:
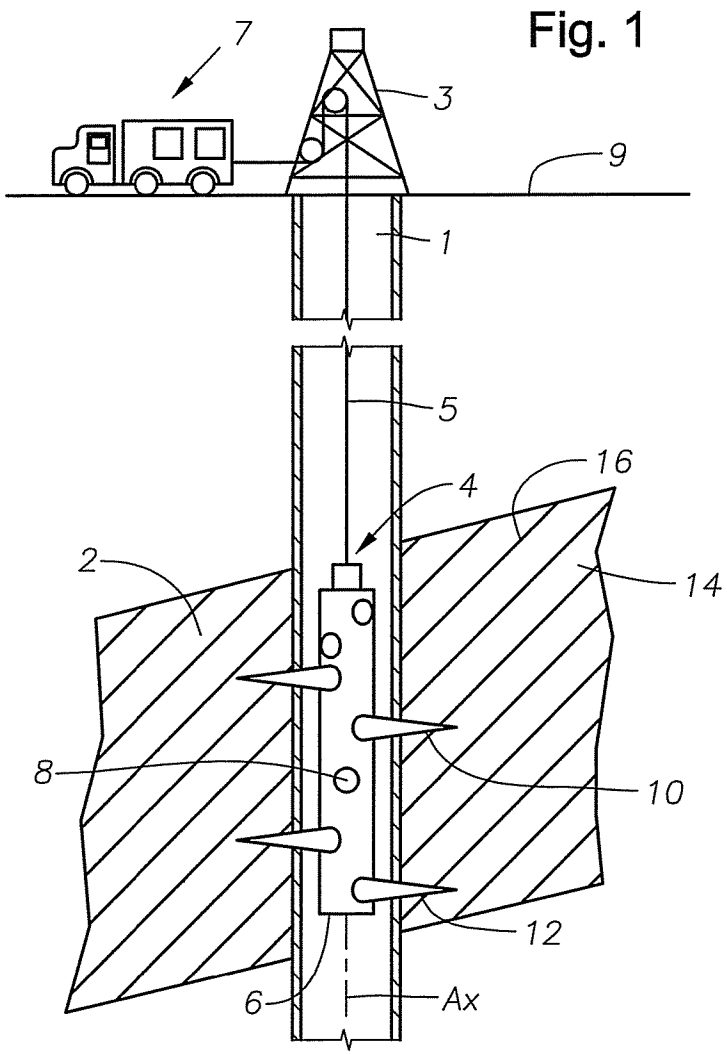
FIG. 1 is partial cutaway side view of a perforating system in a wellbore not aligned with a formation dip angle.

With reference again to FIG. 1 the subterranean formations 2 intersected by the wellbore 1 comprise a series of individual and distinct layers or formations 14. Boundary lines 16 are provided between adjacent formations 14 illustrating a border thereby defining the contour of the formations 14. Each individual formation 14 is defined as a body of subterranean strata, such as rock, comprising predominantly a single type or types of composition. For example, the formation 14 could comprise a type or types of rock having relatively consistent properties throughout that formation 14. Examples of characteristics include permeability, density, porosity, resistivity, saturation, dip angle, stress, and combinations thereof. Optionally, a formation 14 may be comprised of low density material other than rock, such as sand, sediment, sedimentary rock, stratum, or sandstone. For the purposes of discussion herein, the formation 14 can be any stratigraphic unit, including a bed, wherein the beds are distinguishable from one another. Thus the formation 14 includes subterranean layers that are distinguishable from adjacent layers and can have thicknesses measurable in tenths of inches and up to hundreds of feet.

The formations 14 and boundaries 16 as illustrated are oriented generally oblique to the axis $A_X$ of the wellbore 1; perforations 10 are shown formed through the wellbore 1 and into the formation may cross one or more boundary lines 16. These perforations 10 that intersect one or more boundary lines 16 may pass through adjacent strata with different and distinctive properties, thereby affecting the permeability from the strata into the perforation 10.

The method and apparatus disclosed herein includes a manner of perforating with respect to a subterranean formation characteristic. The formation characteristics include formation bedding, formation dip angles, directions of constant stress, including a direction of maximum stress, and isotropic zones such as zones of constant density, porosity, permeability, saturation, and the like. The step of perforating thus includes aiming shaped charges with respect to a line(s) or plane(s) defining the formation characteristic. Aiming may include aligning shaped charges with a formation characteristic, or at a desired angle from a formation characteristic. A plane of maximum stress is defined herein as a plane in which the formation stress exceeds that in an adjacent formation(s). The direction of maximum stress denotes the plane's general trajectory along a line within the formation.

FIG. 2 provides a side partial cross-sectional view of a perforating system 4*a* disposed in a wellbore 1. The perforating system 4*a* includes a perforating gun 6*a* having shaped charges 8 aimed with the intent of forming a jet 12*a* that dodges boundary lines 16. Forming a perforating jet 12*a* that avoids the boundary lines 16 creates perforations 10*a* lying within a single identifiable formation 14 and thus can also be within a single formation characteristic. Moreover, the shaped charge 8 can be aimed so its jet 12*a* is aligned with the formation 14. One example of alignment comprises a perforation 10*a* parallel with one or both of the boundary lines 16 lying adjacent to the particular formation 14.

In one method of forming the perforation 10*a* of FIG. 2, the shaped charge 8 is aimed to form a jet 12*a* largely parallel with the formation 14 dip angle. The dip angle may be defined as the angle at which the formation 14 and/or boundary line 16 lies relative to the axis $A_X$ of the wellbore 1. This is sometimes also referred to as the dip of the formation. Perforating into the formation 14 at its dip angle aligns the perforation 10*a* to the optimal permeability of the reservoir from which hydrocarbons are to be produced. This results in an enhanced and increased flow of hydrocarbons through the perforations 10*a* and into the wellbore 10*a* for production of the hydrocarbons.

Aligning the shaped charges 8 with the dip angle of the formation 14 can be accomplished in any number of ways. In one example, the individual shaped charges 8 are gimbaled within the body of the perforating gun 6*a* and allowed to pivot or gimbal within the gun 6*a*. The gimballing may be further coupled with a perforating gun that rotates azimuthally within the wellbore 1. The azimuthal rotation can be produced by asymmetrically weighting components within the perforating system, such as the gun body 6*a*, a gun tube, shaped charges. Additionally, a motor (not shown) may be included with the system for rotating the gun body 6*a*.

Optionally, a gyroscope (not shown) can be included with the perforating system 4*a* to provide orientation control within the wellbore 1. It should be pointed out that the perforating system 4*a* of FIG. 2 is not limited to a single gun body, but can include multiple gun bodies strung together adjacently as part of a larger string. Other downhole tools may also be provided in the tool string. Additionally, the perforating method described herein is not limited to a vertical wellbore, but can be in deviated as well as horizontal wellbores. As such, the perforating system 4*a* may be disposed on wire line as well as any type of tubing, including coiled tubing and a tractor device.

Another embodiment is provided in side view in FIG. 3 illustrating shaped charges 8*a* statically affixed within a gun body 6*b* at an angle oblique to the gun body axis $A_{X1}$. The shaped charges 8*a* may be disposed in a charge tube that is cylindrical and machined to hold the charges 8*a* pointing at a desired attitude relative to the gun body axis $A_{X1}$. This orientation angle can form perforations 10*a* aligned with the dip angle of the formation 14. The charge tube 18 in this embodiment may be longitudinally split into two or more parts (20, 22) having end fittings 32 at each end to allow the two pieces (20, 22) to be secured at different longitudinal positions with respect to one another. The shaped charge 8*a* ends are shown engaged with holes (24, 25, 26, 27) formed through the charge tube 18 body. When the shaped charge 8*a* ends are engaged in the holes (24, 25, 26, 27) selective longitudinal placement of the charge tube 18 parts (20, 22) in turn angles the shape charges 8*a* oblique to the axis $A_{X1}$. This shifting angularly cants the charges 8*a* for a desired alignment to be shot by the charges 8*a*. The angle of the shaped charge 8*a* can be controlled and selected by adding drilled and tapped holes 30 formed to receive screws or bolts 31 in the end fittings 32.

In another embodiment, the holes (24, 25, 26, 27) in which the shaped charges 8*a* are placed can be enlarged or can be elliptically shaped. Special bushings can be including within the holes (24, 25, 26, 27) to anchor the shaped charges 8*a* in these different holes and align them as desired.

FIG. 4 provides a partial cross sectional view of an example of perforating with respect to a formation characteristic. Here a perforating system 4*b* is disposed in a wellbore 1. Illustrated are jets 12*b* forming perforations 10*b* in a reservoir 36 surrounding the wellbore 1. The jets 12*b* emanate from shaped charges 8*b* in a perforating gun 6*b*. A direction of maximum stress 34 in the reservoir 36 is shown intersecting the wellbore 1. In the example, the direction of maximum stress 34 is generally oblique to the wellbore axis $A_X$. The shaped charges 8*b* have been oriented and/or aligned within the perforating gun 6*b* so the jets 12*b* are either substantially aligned with the direction of maximum stress 34 or extend generally parallel to the direction 34. Optionally the shot phasing on the gun 6*b* may be at 0° and 180°. For example, the shaped charges 8*b* at either 0° or 180° may be aligned with the plane and oriented to form a perforation 10*b* in the plane 34 coincident with the azimuth radial position where the angle between the direction 34 and the wellbore axis $A_X$ is at a minimum. Using the embodiment of FIG. 4 as an example, if the 0° phased shot is directed azimuthally as described above and angled upward, the shot at 180° phasing would also be aligned in the plane and directed downward.

Figure 5:
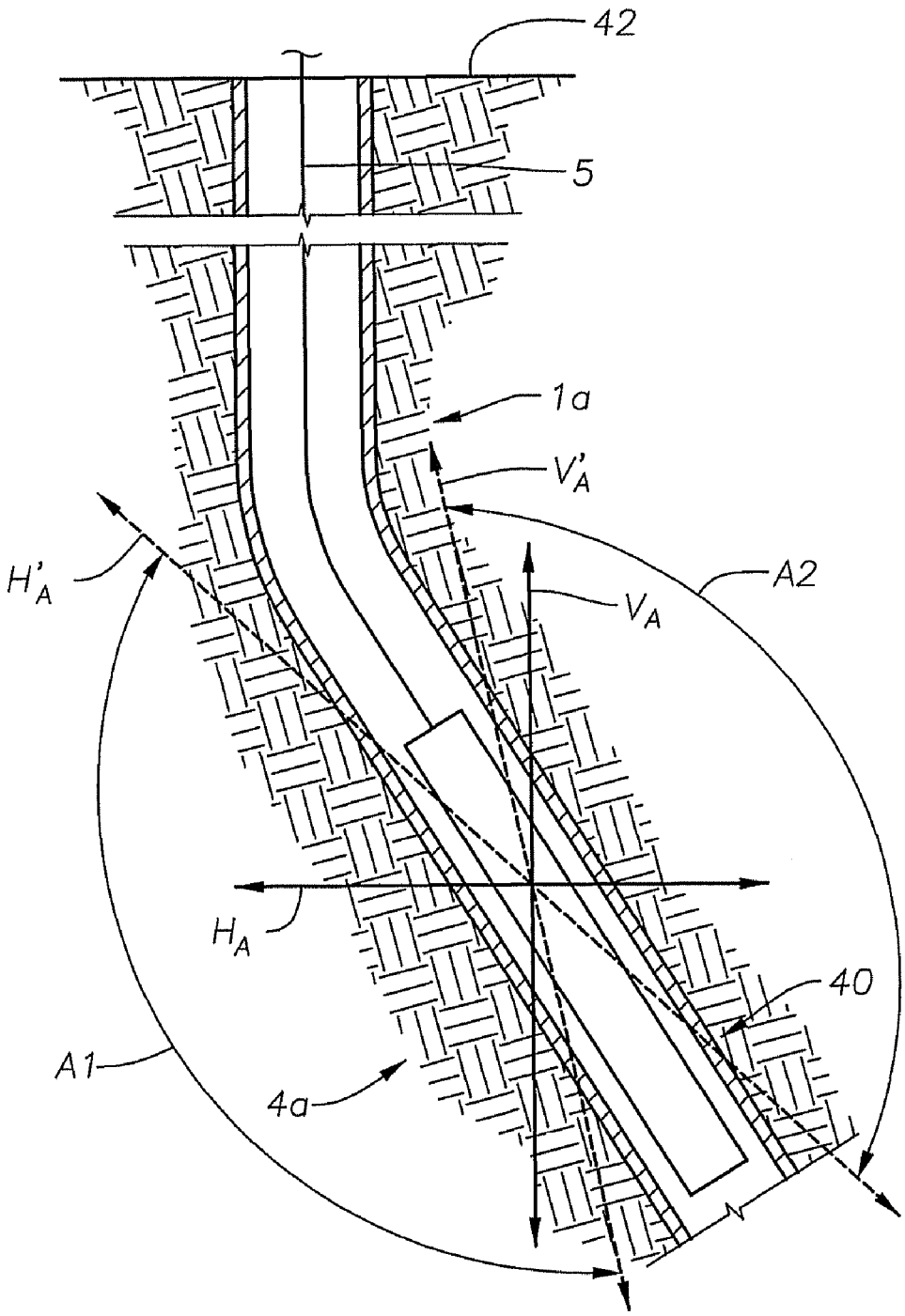
FIG. 5 is a partial cutaway view of a perforating gun in a deviated wellbore.

FIG. 5 is a cross sectional view of an embodiment of a perforating system 4*a* in accordance with the present disclosure disposed in a deviated wellbore 1*a*. The perforating gun 6*a* is disposed on wireline 5 in the deviated portion 40 of the wellbore 1*a*. A coordinate axis $V_A$ and $H_A$ are provided that represent potential shot direction. $V_A$ is largely parallel with vertical axis at surface 42 and $H_A$ is largely parallel with horizontal axis at surface 42. Also provided is a dashed axis $V_A'$ and $H_A'$, these lines graphically illustrate ranges of shot angles ($A_1$, $A_2$) possible with a perforating device, such as an angled perforating system as described herein. $A_1$ and $A_2$ are greater than 90°, and may be equal in some instances. Thus implementation of the angled shaped charges provides for shot angles that exceed vertical and horizontal alignments.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein.

What is claimed is:

1. A method of perforating a wellbore that intersects a formation having adjacent first and second subterranean layers and a boundary separating the first and second layers, the method comprising:

identifying the boundary;

providing a perforating gun having a shaped charge selectively adjustable to be oriented at oblique angles with respect to an axis of the perforating gun;

orienting the shaped charge in a direction that avoids the boundary by holding opposing ends of the shaped charge and moving one of the ends to orient the shaped charge at a desired attitude relative to the axis of the gun body; and directing a perforating jet from the shaped charge into the first layer along a path that avoids the boundary.

2. The method of claim 1, wherein the boundary intersects the wellbore at an oblique angle and wherein directing the perforating jet comprises azimuthally and attitudinally orienting the perforating jet.

3. The method of claim 1, further comprising a directing another perforating jet into the formation along a path that avoids the boundary.

4. The method of claim 1, wherein the formation includes a third subterranean layer adjacent the second layer and an additional boundary between the second and third layers.

5. The method of claim 4, further comprising directing another perforating jet into the first layer so that the perforating jet avoids the boundary separating the first and second layers.

6. The method of claim 4, further comprising directing another perforating jet into the second layer so that the perforating jet avoids the boundaries.

7. The method of claim 1, wherein the perforating jet comprises a first perforating jet, the method further comprising detecting a plane of maximum stress in the formation and directing the first perforating jet into the plane of maximum stress.

8. The method of claim 7, further comprising directing a second perforating jet into the plane of maximum stress that is aimed 180° away from the first perforating jet directed into the plane of maximum stress.

* * * * *